United States Patent [19]

Kreder et al.

[11] 4,350,276

[45] Sep. 21, 1982

[54] ARRANGEMENT FOR ALIGNING A MATERIAL WEB, PARTICULARLY A VENEER WEB

[76] Inventors: Hans Kreder, Im Asemwald 2/8, 7000 Stuttgart 70; Horst Weislogel, Marquardtstrasse 15, 7000 Stuttgart 1, both of Fed. Rep. of Germany

[21] Appl. No.: 141,110

[22] Filed: Apr. 17, 1980

[30] Foreign Application Priority Data

Apr. 26, 1979 [DE] Fed. Rep. of Germany ..... 2916828

[51] Int. Cl.[3] ..... B65H 25/26; B65H 25/24

[52] U.S. Cl. ..... 226/16; 226/24

[58] Field of Search ..... 226/16, 24, 27, 28, 226/29, 43

[56] References Cited

U.S. PATENT DOCUMENTS 2,220,736 11/1940 Stockbarger ..... 226/16 X 2,378,234 6/1945 Meyer ..... 226/16 X 3,705,675 12/1972 Ram ..... 226/16

4,155,496 5/1979 Houck ..... 226/16

*Primary Examiner*—Edward J. McCarthy

*Attorney, Agent, or Firm*—McGlew and Tuttle

[57] ABSTRACT

An arrangement for aligning a cross line of a material web moving in a given direction along a bearing surface, particularly a veneer web of veneer sheets, with a set position, includes a monitor for monitoring the position of a cross line and detecting a deviation of the cross line from a set position, a retaining mechanism for restraining movement of a leading side of the material web relative to a trailing side of the material web in the direction of movement, the monitor being operable to actuate the retaining mechanism associated with the leading side to restrain the leading side relative to the trailing side until the actual position of the cross line coincides with a set position.

19 Claims, 2 Drawing Figures

ARRANGEMENT FOR ALIGNING A MATERIAL WEB, PARTICULARLY A VENEER WEB

FIELD AND BACKGROUND OF THE INVENTION

The invention relates to an arrangement for aligning a material web moving in a given direction along a bearing surface, particularly a veneer web formed of veneer sheets. Material webs can run for various reasons obliquely to a given direction of motion, and this is undesired in most cases, particularly if they are to be divided into different parts cut perpendicularly to the two longitudinal edges of the material web. Particularly in veneer webs, formed of veneer sheets, it is desirable to have a cut perpendicularly to the two longitudinal edges, so that the grain in the so-called veneers formats shows a substantially vertical course.

SUMMARY OF THE INVENTION

The object of the invention is therefore to provide an arrangement by means of which material webs, particularly veneer webs, can be aligned, if necessary, relative to the given direction of motion.

In accordance with the invention, an arrangement is provided for aligning a material web, moving in a given direction along a bearing surface, particularly a veneer web of veneer sheets, having means for monitoring a cross line of the web material, particularly its trailing edge, which upon a deviation in the position of the cross line from a set position activates a retaining mechanism associated with the leading portion of the cross line for repositioning of the material web until the actual position coincides with the set position. The monitor, according to one embodiment of the invention, drives a first driving mechanism associated with the leading portion at a lower speed than a second driving mechanism associated with a trailing portion of the material web in order to coincide the actual position of the cross line with the set position. If the veneer web does not have a cross line to be used for reference purposes, it is advisable to use the front or rear transverse edge, preferably the trailing edge. As a rule, the ideal line extends perpendicularly to the direction of feed of the material web, and in the case of straight longitudinal material edges, also perpendicularly to the latter, so that it is surmised below that the cross line is to have this perpendicular course without this being considered a limitation. For simplicity only the "trailing edge" of the material web will be referred to here and after.

In accordance with another embodiment of the invention, the monitor is likewise controllable by a cross line of the material web, particularly the trailing material edge, but the monitor cooperates here with the driving mechanisms, arranged laterally side by side in a distance from each other, in particular symmetrically to the longitudinal center axis of the bearing surface. In normal operation, these two driving mechanisms feed the material web along the bearing surface at the same speed. The arrangement can be such that one driving mechanism is associated with the left and the other with the right half of the material web. In the case of a double machine, as shown in FIG. 2 of the drawing, four driving mechanisms or two pairs of such driving mechanisms would therefore have to be provided. An arrangement with double the working range could also be provided in which the longitudinal center axis of the bearing surface would be between the veneer webs shown in FIG. 2. In any case, the driving mechanism associated with the left side of the material web, viewed relative to the feed direction, would then run at a lower speed, if the left half were leading the right half, and vice versa.

Theoretically, the left driving mechanism could be stopped until the material web is aligned, but this is not advisable for every material web, particularly not for veneer webs formed of veneer sheets. There it is better if one speed is reduced relative to the other. This naturally also includes the possibility of increasing the speed of the driving mechanisms relative to the normal speed associated with the trailing side of the material web. It is advisable, however, to reduce the speed on the leading side instead of increasing the speed on the trailing side. Naturally, both the retaining mechanism and the auxiliary driving mechanism are unnecessary in the second alternative.

The monitoring element of the monitor is naturally arranged along the ideal line, and it is quite sufficient and also highly advantageous if only two points or parts of the trailing edge spaced laterally from each other and associated, if possible, with the two lateral edge zones of the material web are monitored. If a deviation of the actual value of the direction of this trailing edge from the nominal value is found, the monitor activates a retaining mechanism which is or must be associated with the leading part of the cross line in advance. This retaining mechanism retains either the left or right side of the material web in the edge zone, while a feed drive continues to run. If the left edge zone is retained, for example, the feed drive can no longer feed the material web to the left, and this leads necessarily to a rotation of the material web about the point where the material web is retained on the left side. Naturally the retention must be confined to a relatively small area and must be such that rotation by means of the feed drive is possible. When the trailing edge has assumed the preferred vertical position relative to the direction of feed, the retaining mechanism is released again by the monitor and the material web can be moved in aligned position. A further development of the arrangement is characterized by an auxiliary driving mechanism controlled by the monitor, where the monitor starts the auxiliary driving mechanism upon a deviation of the cross line from a set position. This opens up the possibility of varying the power feed of the drive on the material web and/or the rate of feed. It is of particular advantage that the auxiliary driving mechanism is associated with the trailing part of the cross line. If, in order to remain with the same example, the left range of the material web is retained, the auxiliary driving mechanism acts on the right side of the material web. Seen in the direction of motion of the material web, the auxiliary driving mechanism is preferably arranged behind the retaining mechanism. Both define an alignment feeding axis extending obliquely to the trailing edge.

A particularly preferred embodiment of the invention is characterized by a two part retaining and auxiliary driving mechanism, where one part each of the retaining and auxiliary driving mechanism is associated with the left and right side of the material web, and the left part of the retaining mechanism is started by the monitor together with the right part of the auxiliary driving mechanism, and the right part of the retaining mechanism together with the left part of the auxiliary driving mechanism, preferably simultaneously. After the alignment of the trailing edge, the retaining and auxiliary driven mechanisms; are naturally deactivated substantially at the same time. A two-part construction permits a relatively simple design of the retaining and auxiliary driving mechanism, as well as elimination of the transverse adjustment as a function of the respective direction of the oblique trailing edge. Another variant of an arrangement with a monitor for the trailing edge of the material web provides that the monitor is arranged in the direction of motion of the material web ahead of the retaining mechanism. There is thus still sufficient room for applying the retaining mechanism, which in the case of retention, has normally already crossed the monitoring line with its area to be retained.

In this connection it is of particular advantage that the monitor consists of at least two parts, one part being associated with the left, and the other part with the right longitudinal edge of the material web. For monitoring at least one substantially straight cross line or trailing edge, two laterally displaced part-monitors are sufficient. If only two points of relatively small areas of the trailing edge are used for monitoring its oblique position, a relatively simple monitor can be used.

Another feature of the invention provides that the left part of the monitor is designed as a starting device for the left part of the retaining mechanism and particularly also for the right part of the auxiliary driving mechanism, and the right part of the monitor as a stopping device for the mechanisms that have already been started, and vice versa. Accordingly both sides can assume both starting and stopping functions, their respective operation depending entirely on the oblique position of the trailing edge. The parts of the monitor associated with the leading range or part of the trailing edge starts the mechanisms, while the part of the monitor associated with the trailing part of the trailing edge is so influenced, e.g. by switching, that it stops the mechanisms or parts thereof that have already been started, as soon as it is made to do so by the trailing edge.

According to another feature of the invention, the main drive for feeding the material web is adjustable or reversible.

An expedient variation of the invention provides that the monitor consists of two laterally displaced light sources defining the set position which are equipped with photocells or similar known means. As long as the material web moves past the photocells etc. they cannot recognize their associated light source. But when the part of the trailing edge moving past its range clears the beam, this leads automatically to a control pulse at least for the retaining device.

In an arrangement where the material web is displaceable by means of lower cylinders and upper liftable rollers, another feature of the invention is that the adjustment of the auxiliary driving mechanism is coupled with the lifting of the upper rollers. The normal drive is thus shut off, and the rotation is effected solely by the auxiliary driving mechanism, which has been started at least substantially simultaneously. This opens up the possibility of effecting this operation particularly sensitively and gently.

The auxiliary driving mechanism consists in a further development of the invention of at least one lower roller or cylinder and one upper adjustable roller, but particularly of a lower driven cylinder and of two alternately adjustable rollers arranged in a lateral distance from each and associated with the left and right edge zone of the material web, where the left roller with the cylinder forms the left part, and the right roller with the cylinder forms the right part of the auxiliary driving mechanism of the auxiliary driving mechanism. The use of rollers and/or cylinders for the auxiliary driving mechanism permits, in a particularly advantageous manner, use of rollers and/or cylinders of the standard feed drive as an auxiliary driving mechanism. In the latter case, all rollers can be lifted from their counter-rollers, with the exception of a single roller, for example, which forms then the auxiliary driving mechanism with its counter-roller or cylinder.

In another embodiment of the invention, the retaining mechanism is composed of at least one bottom and top cheek plate, of which at least one is controllable by auxiliary energy. The retaining mechanism consists preferably of a left and right bottom and top cheek plate, where the bearing surface has at least one opening or one opening each for the left and right bottom cheek plate. Between the two pressure surfaces of the adjusted bottom and top cheek plate, the material web is so retained that the latter can be rotated but not pulled through to this end the pressure surfaces can be mounted rotatably on corresponding mounts of the retaining mechanism. It is of particular advantage if the diameter of a piston of a bottom press cylinder of the bottom cheek plate is greater than that of the upper piston, because the axial force of the lower piston exceeds then that of the upper piston, with equal hydraulic or pneumatic pressure in the cylinders of the respective retaining mechanism, and the material web can therefore be lifted slightly from its bearing surface so that the friction during rotation can be reduced.

When this arrangement is installed in a so-called clipper, it can be started by means of the working stroke of the clipping blade. It remains shut off so long until the clipping blade performs a new working stroke. Instead it is naturally also possible to perform in an expedient manner another, e.g. a time-dependent, joint-dependent, or a permanent check. In two- or multi-web operation, two or more of these arrangements can be provided side by side.

Accordingly, it is an object of the invention to provide an arrangement for aligning a cross line of a material web moving in a given direction along a bearing surface, particularly a veneer web of veneer sheets, with a set position comprising means for monitoring the position of the cross line and detecting a deviation of the cross line from a set position, retaining means for restraining movement of a leading side of the material web relative to a trailing side of the material in the direction of movement, the monitoring means being operable to actuate the retaining means associated with the leading side to restrain the leading side relative to the trailing side until the actual position of the cross line coincides with the set position, and feed drive means for urging the material in the given direction.

A further object of the invention is to provide an arrangement for aligning a cross line of a material web moving in a given direction which is simple in design, rugged in construction and economical to manufacture.

DESCRIPTION OF THE PREFERRED EMBODIMENT

Figure 1:
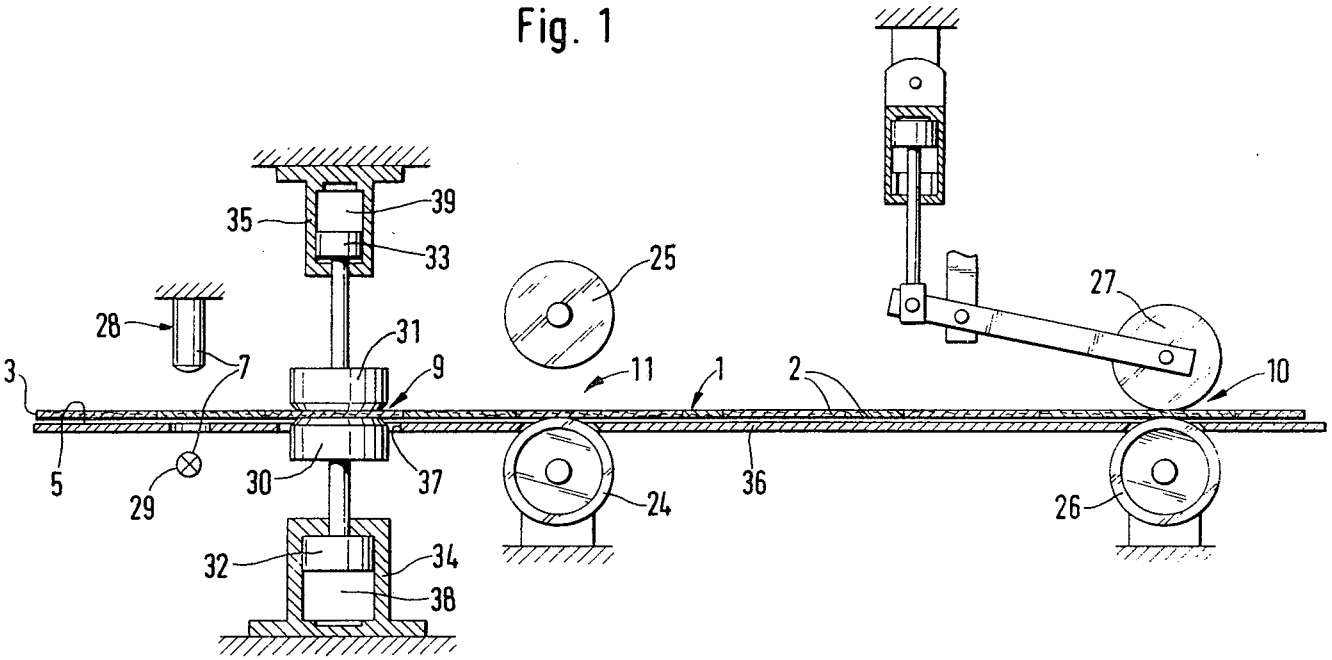
FIG. 1 is a schematic side elevational view of an arrangement according to the invention.
Figure 2:
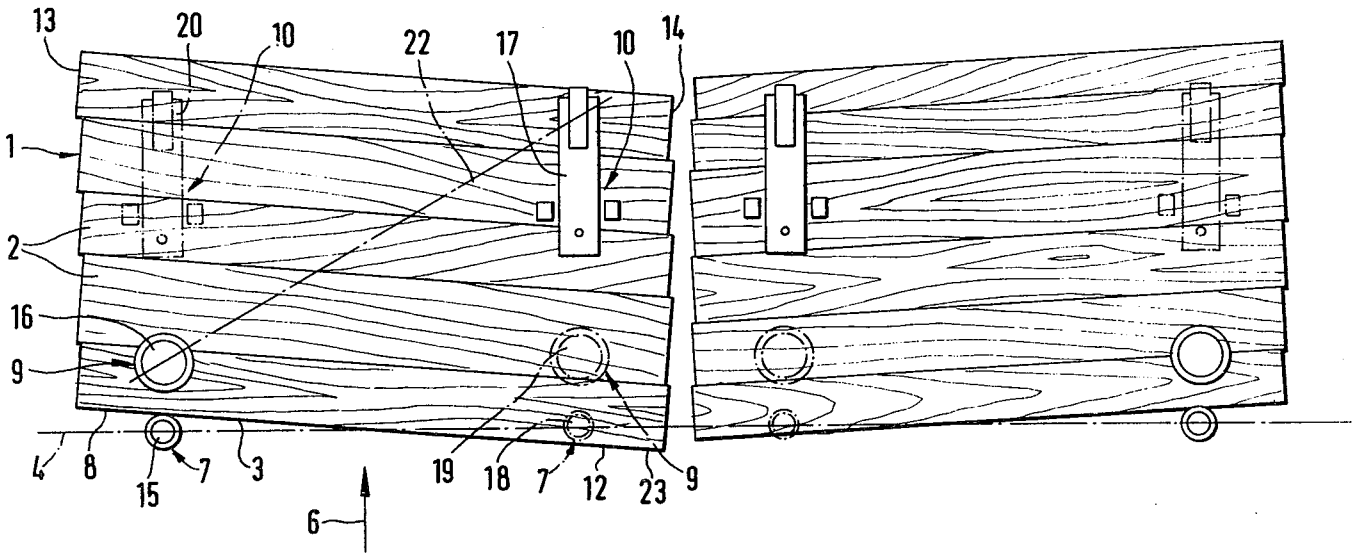
FIG. 2 shows top view of the arrangement of FIG. 1.

Referring now to the drawings in particular, which illustrate a preferred embodiment of an arrangement for aligning a cross line of a material web moving in a given direction along a bearing surface with a set position and wherein like reference characters represent the same or corresponding parts throughout the several views there is shown an arrangement serving to align a material web, e.g. a veneer web formed of veneer sheets. The alignment refers to a cross line 3 of the material web, particularly its trailing edge. It is aligned, e.g. relative to an ideal line 4, which is defined by a line of bearing surface 5 for material web 1 which extends preferably perpendicularly to the longitudinal edges of the aligned material web 1. Alignment is also conceivable relative to a line extending in an angle, e.g. a right angle, to the aligned cross line, like the feeding or moving direction of material web 1 symbolized by arrow 6. The alignment is effected by means of a monitor 7, which starts a retaining mechanism 9 associated with the leading part 8 of the cross line in a deviation of the cross line 3 from its ideal position, until actual and ideal position coincide. In addition, an auxiliary driving mechanism 10 is provided, which is controlled by monitor 7 in such a way that it is started in a deviation of the cross line from its ideal position. Preferably, a main drive 11 is shut off at the same time or otherwise made inoperative. The auxiliary driving mechanism 10 is associated with the trailing part 12 of cross line 3. Preferably monitor 7, a retaining mechanism 9 and auxiliary driving mechanism 10 consist each of two parts, their left part being arranged in the vicinity of the left longitudinal edge 13 and their right part in the vicinity of the right longitudinal edge 14 of material web 1 relative to the feeding and moving direction. In FIG. 2 the left part 15 of monitor 7, and the left part 16 of retaining mechanism 9, as well as the right part 17 of auxiliary driving mechanism 10 are indicated by solid lines, while the right part 18 of monitor 7, the right part 19 of retaining mechanism 9, and the left part 20 of auxiliary driving mechanism 10 are presented by broken lines. This is due to the fact that the leading of the left part of cross line 3 is detected by the left part 15 of monitor 7, and this leads to the start of the left part 16 of retaining mechanism 9 and of the right part 17 of auxiliary driving mechanism 10. The same holds true when the right end 23 of cross line 3 leads, and this is detected by the right part 18 of monitor 7.

The left part 16 of retaining mechanism 9 and the right part 17 of auxiliary driving mechanism 10 lie on an alignment feed axis 22. Another alignment feed axis (not shown) extends from the right part 19 of retaining mechanism 9 to the left part 20 of auxiliary driving mechanism 10. When the left part 8 leads the ideal line 4, the right part 18 of monitor 7 acts as a stopping device. It loosens the left part 16 of retaining mechanism 9 and makes the right part of auxiliary driving mechanism 10 inoperative. Provided the starting of auxiliary driving mechanism 10 resulted in the stopping of main drive 11, the latter is started again over the right part 18 of monitor 7. The same holds true when the right end 23 of cross line 3 leads, that is, the left part 15 of monitor 7 assumes then these stopping functions and the start of main drive 11, if necessary.

When monitor 7 detects a deviation of cross line 3 from the ideal position, it stops main driving mechanism 11, as mentioned above, and starts auxiliary driving mechanism 10. If main drive 11 is not stopped by monitor 7 or a part thereof serves in an advantageous manner as an auxiliary driving mechanism 10, the monitor can also effect a reduction of the rate of feed of the material web so that the latter moves during the alignment at a so-called creeping pace. When the main drive, which consists preferably of lower cylinders 24 and upper liftable rollers 25 cooperating with them, is stopped, the latter are turned or moved into an inoperative position. Auxiliary driving mechanism 10 can consist of at least one lower roller or cylinder 26 and one upper adjustable roller 27. It is readily understandable that roller or cylinder 26 and roller 27 can be a part of main drive 11 or they can be separate elements. In the former case, all movable rollers 25 are lifted in the alignment of material web 1, while roller 27 remains in operating position, but the speed of revolution of the driving roller or cylinder is reduced. The increase in speed after the alignment of the material web is effected simultaneously with the adjustment of lifted rollers 25. Monitor 7 consists preferably of one, or in a two-part design, of two photocells 28, which are installed preferably above the material web, and of one or two associated light sources 29.

Retaining mechanism 9 consists of at least one lower cheek plate 30 and an associated upper cheek plate 31, which are preferably both rotatable and self-adjustable. It is adjusted by means of an auxiliary force, e.g. with pneumatic pressure. To this end, lower cheek plate 30 is connected movably with lower piston 32, and upper cheek plate 31 with an upper piston 33. These piston are rotatably mounted in their cylinders, which can be designed as double-action pneumatic cylinders (not shown), to prevent damage to the material web during the alignment. Naturally a lower and upper cheek plate 30 and 31 is associated with the left and right edge zone of material web 1. In an alignment they clamp material web 1 between their contact surfaces. To this end, a machine table 36 has an opening 37 each for the passage of the left and right upper press cheek 30.

Piston 32 of the lower left and right cylinder 34 has a larger diameter than piston 33 of the upper left and right cylinder 35. With the same pressure in chambers 38 and 39, the axial force of the lower cheek plate 30 is therefore slightly higher than that of the upper cheek plate 31, and this leads to a slight lifting of material web 1 from its bearing surface 5. The friction during the alignment and rotation respectively of the material web is therefore relatively low, and this means considerable protection of the material. This also greatly reduces the risk of damage, particularly in sensitive veneer webs, and finally lesser forces are required for the rotation and alignment.

As it can be seen from FIG. 2, two or more arrangements according to the invention can be arranged readily side by side, so that they are also suitable for dual or multiple operation. For reasons of clarity, no reference numbers have been entered in the second material web (right half of FIG. 2). The arrangement need not be turned on constantly, it suffices rather if it is turned on and off in given or selected intervals determined by a certain control. Thus, for example control by a so-called clipper is possible, in such a way that the arrangement is turned on when the clipper blade (not shown) has separated a piece, e.g. a so-called veneer format, which has already passed the ideal line 4 (cross line 3).

If the position of a cross line (3) deviates from an ideal line (4) and a material web (1) is therefore not moved exactly in the intended direction of feed, this leads to an undesired oblique cut relative to the two longitudinal edges (13) and (14) when the material web is subsequently cut into individual sections. Consequently it is always necessary to align the material web relative to the ideal line (4) at least from time to time.

The deviation from the set position is determined by a monitor (7) consisting preferably of two parts. If the left part (8) of the trailing edge or of any other given cross line (3) leads the material web, for example, monitor (7) causes activation of the left part (16) of a retaining mechanism (9) and of the right part (17) of an auxiliary driving mechanism (10). Preferably the main drive (11) is disconnected at the same time, and the material web (1) moved at a crawling speed. But this is only possible in the range of the right part (17) of the auxiliary driving mechanism (10), and consequently the material web (1) is turned counter-clockwise about the left part (16) of the remaining mechanism (9), that is, it is aligned. A similar process takes place when the right end (23) leads the cross line (3).

While a specific embodiment of the invention has been shown and described in detail to illustrate the application of the principles of the invention, it will be understood that the invention may be embodied otherwise without departing from such principles.

I claim:

1. An arrangement for aligning a cross line of a material web moving in a given direction along a bearing surface, particularly a veneer web of veneer sheets, with a set portion comprising means for monitoring the position of the cross line and detecting a deviation of the cross line from a set position, retaining means for restraining movement of a leading side of the material web relative to a trailing side of the material web in the direction of movement, said monitoring means being operable to activate said retaining means associated with the leading side to restrain the leading side relative to the trailing side until the actual position of the cross line coincides with the set position, and feed drive means for urging the material in the given direction.

2. An arrangement as set forth in claim 1 wherein said feed drive means is operative to drive opposite sides of the web material relative to the direction of movement at different speeds, and said monitoring means is operable to actuate said feed drive means to drive the leading side of the web material at a lower speed than the trailing side of the web material until the actual position of the cross line coincides with the set position.

3. An arrangement as set forth in claim 1 wherein said retaining means further comprises auxiliary drive means operable to drive opposite sides of the web material relative to the direction of movement and said monitoring means is operable to actuate said auxiliary driven means upon a deviation of the cross line from the set position.

4. An arrangement as set forth in claim 3 wherein said auxiliary drive means is operable to drive the trailing side of the material web.

5. An arrangement as set forth in claim 4 wherein said retaining means comprises a first retaining mechanism and a second retaining mechanism adapted to retain opposite sides of the material web and wherein said auxiliary drive means comprises a first auxiliary drive mechanism and a second auxiliary drive mechanism adapted to drive opposite sides of the material web.

6. An arrangement according to claim 5 wherein one of the retaining and driving mechanisms is associated with the left side and the other with the right side of the material web, and said monitoring means being operable to actuate the left retaining mechanism and the right auxiliary mechanism or the right retaining mechanism and the left auxiliary driving mechanism simultaneously.

7. An arrangement according to claim 6 wherein said monitoring means is operable for monitoring the trailing edge of the material web and is disposed upstream of the retaining mechanisms in the direction of motion of the material web.

8. An arrangement according to claim 7 wherein said monitoring means comprises at least two monitor parts, one monitor part being adapted to monitor the left longitudinal edge and the other monitor part being adapted to monitor the right longitudinal edge of the material web.

9. An arrangement according to claim 8 wherein the left monitor part is operable to activate the left retaining mechanism and the right part of the auxiliary driving mechanism and the right monitor part.

10. An arrangement according to claim 1, wherein said feed drive means is operable to adjust the feed rate and reverse the drive direction, and said monitoring means is operable to actuate the feed drive means to reduce the rate of feed in a deviation of the cross line from the set position until the set position is reached.

11. An arrangement according to claim 9 wherein said monitoring means comprises two laterally displaced lightsources and photocells associated with the light source defining the set position.

12. An arrangement according to claim 10 wherein said monitoring means comprises two laterally displaced light sources and photocells associated with the light source defining the set position.

13. An arrangement according to claim 2 further comprising means for lifting the material from the base operatively connected to said auxiliary driving means.

14. An arrangement according to claim 2 wherein said auxiliary driving means comprises at least one lower roller and one upper adjustable roller.

15. An arrangement according to claim 14 wherein said lower roller comprises a lower driven cylinder and said upper adjustable roller comprises two alternately adjustable rollers arranged at a lateral distance from each other and associated with the left or right sides of the material web and wherein the left roller forms with the cylinder a left auxiliary driving mechanism and the right roller forms with the cylinder a right auxiliary driving mechanism.

16. An arrangement according to claim 1 wherein said retaining means comprises at least one lower and one upper cheek plate of which at least one is controllable by means of auxiliary energy.

17. An arrangement according to claim 16 wherein the retaining means comprises a left and a right lower and upper cheek plate and that the bearing surface has an opening for the passage of the left and right lower cheek plate.

18. An arrangement according to claim 17 wherein the retaining means comprises a lower piston operatively connected to the lower cheek plate and upper piston operatively connected to the upper cheek plate wherein the lower piston has a diameter greater than that of the upper piston.

19. An arrangement according to claim 17 wherein each of said cheek plates is rotatable about an axis extending perpendicularly to its pressing surface.

* * * * *